US006976643B2

(12) United States Patent
Hokao

(10) Patent No.: US 6,976,643 B2
(45) Date of Patent: Dec. 20, 2005

(54) FUEL INJECTION DEVICE FOR INTERNAL COMBUSTION ENGINE

(75) Inventor: Takayuki Hokao, Anjo (JP)

(73) Assignee: Denso Corporation, (JP)

( * ) Notice: Subject to any disclaimer, the term of this patent is extended or adjusted under 35 U.S.C. 154(b) by 128 days.

(21) Appl. No.: 10/663,733

(22) Filed: Sep. 17, 2003

(65) Prior Publication Data

US 2004/0061005 A1 Apr. 1, 2004

(30) Foreign Application Priority Data

Sep. 18, 2002 (JP) ..... 2002-271216

(51) Int. Cl.[7] ..... F02M 59/00; F02M 61/00; F02M 61/10; F02M 63/00; B05B 1/30

(52) U.S. Cl. ..... 239/533.12; 239/533.2; 239/533.11; 239/585.1; 239/585.5

(58) Field of Search ..... 239/533.12, 533.2, 239/533.11, 585.1, 585.5, 533.3, 533.9, 585.2, 239/585.3, 585.4

(56) References Cited

U.S. PATENT DOCUMENTS 5,516,047 A * 5/1996 Kubach et al. ..... 239/585.5
5,762,272 A 6/1998 Tani et al.
2001/0040194 A1 11/2001 Yamaguchi et al.

FOREIGN PATENT DOCUMENTS

JP 2839708 10/1998

* cited by examiner

*Primary Examiner*—Justine R. Yu
*Assistant Examiner*—Darren Gorman
(74) *Attorney, Agent, or Firm*—Nixon & Vanderhye PC

(57) ABSTRACT

In a fuel injection device, a valve seat is formed on an inner peripheral surface of a valve body. The valve seat and a contacting portion of a needle form a sealing portion. Virtual perpendicular lines, which cross the sealing portion and are perpendicular to the inner peripheral surface of the valve body, intersect with each other at an intersecting point on a movable core side. The intersecting point is positioned between a first end of a guiding portion on a sealing portion side and a second end of the guiding portion opposite from the sealing portion. An end of the needle on a contacting portion side rotates around the intersecting point. Contact between the needle and the guiding portion is inhibited by positioning the intersecting point near the guiding portion.

17 Claims, 5 Drawing Sheets

FUEL INJECTION DEVICE FOR INTERNAL COMBUSTION ENGINE

CROSS REFERENCE TO RELATED APPLICATION

This application is based on and incorporates herein by reference Japanese Patent Application No. 2002-271216 filed on Sep. 18, 2002.

BACKGROUND OF THE INVENTION

1. Field of the Invention

The present invention relates to a fuel injection device for an internal combustion engine.

2. Description of Related Art

Conventionally, as a fluid injection device for injecting fluid such as fuel, a device in which a contacting portion of a valve member is seated on a valve seat of a nozzle body or separates from the valve seat in order to inject the fluid intermittently is publicly known, for instance, as disclosed in Japanese Patent No. 3183156. In such a fluid injection device, electromagnetic driving means disposed in an end of the valve member opposite from the contacting portion reciprocates the valve member.

Lately, in accordance with improvement in performance of the engine, improvement of response of the fuel injection device during operation is required. The response of the fuel injection device can be improved effectively by reducing size and weight of the valve member as a movable member.

However, if the whole length of the valve member in an axial direction is contracted to reduce its size, stability of the valve member in the axial direction may be reduced, so the valve member may tend to incline with respect to the axis. If the valve member inclines when the contacting portion is seated on the valve seat of a valve body (the nozzle body), there is a possibility that guiding means may contact the valve member. For instance, the guiding means is formed in the valve body in order to guide the valve member so that the valve member can reciprocate in the axial direction. If the valve member contacts the guiding means, the end of the valve member on the contacting portion side will rotate around a contact point between the valve member and the guiding means (the contact point functions as a supporting point). In such a case, there is a possibility that the contacting portion of the valve member may separate from the valve seat. As a result, sealing performance between the contacting portion and the valve seat may be decreased, and fuel leak may be caused.

The contact between the valve member and the guiding means can be prevented by enlarging a clearance formed between the valve member and the guiding means. However, if the clearance formed between the valve member and the guiding means is enlarged, the stability of the valve member during the operation may be reduced, and variation in fuel injection quantity may be caused.

SUMMARY OF THE INVENTION

It is therefore an object of the present invention to provide a fuel injection device having improved response, in which a valve member is downsized without decreasing sealing performance at a sealing portion or causing variation in fuel injection quantity.

According to an aspect of the present invention, an intersecting point, at which arbitrary virtual perpendicular lines crossing a sealing portion intersect with each other, is positioned between an end of guiding means on the sealing portion side and the other end of the guiding means in a fuel injection device. An end of a valve member on the contacting portion side rotates around the intersecting point. Therefore, even if the valve member inclines, contact between the guiding means and the valve member is inhibited because the guiding means is disposed near the intersecting point, around which the valve member rotates. As a result, even if whole length of the valve member in an axial direction is contracted, the contact between the valve member and the guiding means is inhibited. Since the contact between the valve member and the guiding means is inhibited, there is no need to enlarge a distance between an inner surface of a valve body and an outer surface of the valve member, which form the guiding means. Therefore, the valve member can operate stably. Thus, even if the valve member is downsized, response of the valve member can be improved without decreasing sealing performance at the sealing portion or causing variation in fuel injection quantity.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF THE REFERRED EMBODIMENTS (First Embodiment)

Figure 2:
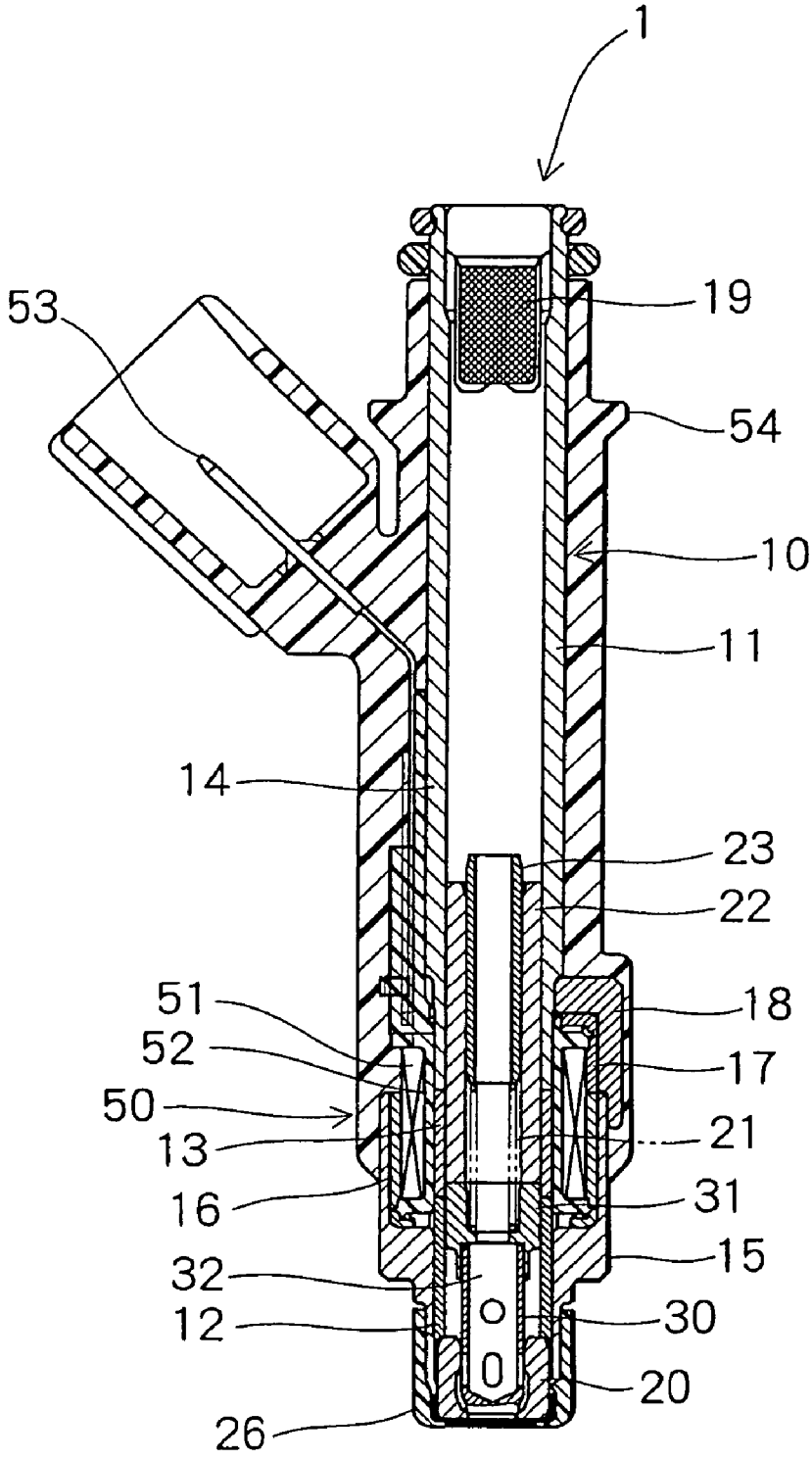
FIG. 2 is a cross-sectional view showing the injector according to the first embodiment.

Referring to FIG. 2, an injector 1 as a fuel injection device according to the first embodiment is illustrated. As shown in FIG. 2, a holder 10 of the injector 1 is formed in the shape of a cylinder including magnetic members and a nonmagnetic member. A fuel passage 11 is formed in the holder 10. A valve body 20, a needle 30 as a valve member, a movable core 31, a spring 21, a fixed core 22 and an adjusting pipe 23 are accommodated in the fuel passage 11.

The holder 10 has a first magnetic member 12, a nonmagnetic member 13 and a second magnetic member 14 in that order from the valve body 20 side, which is a lower side in FIG. 2. The first magnetic member 12 and the nonmagnetic member 13 are connected with each other by welding. The nonmagnetic member 13 and the second magnetic member 14 are connected with each other by welding. For instance, laser welding is employed as the welding method. The nonmagnetic member 13 prevents short-circuiting of magnetic flux between the first magnetic member 12 and the second magnetic member 14. The valve body 20 is fixed to an end of the first magnetic member 12 opposite from the nonmagnetic member 13 by welding.

Figure 1:
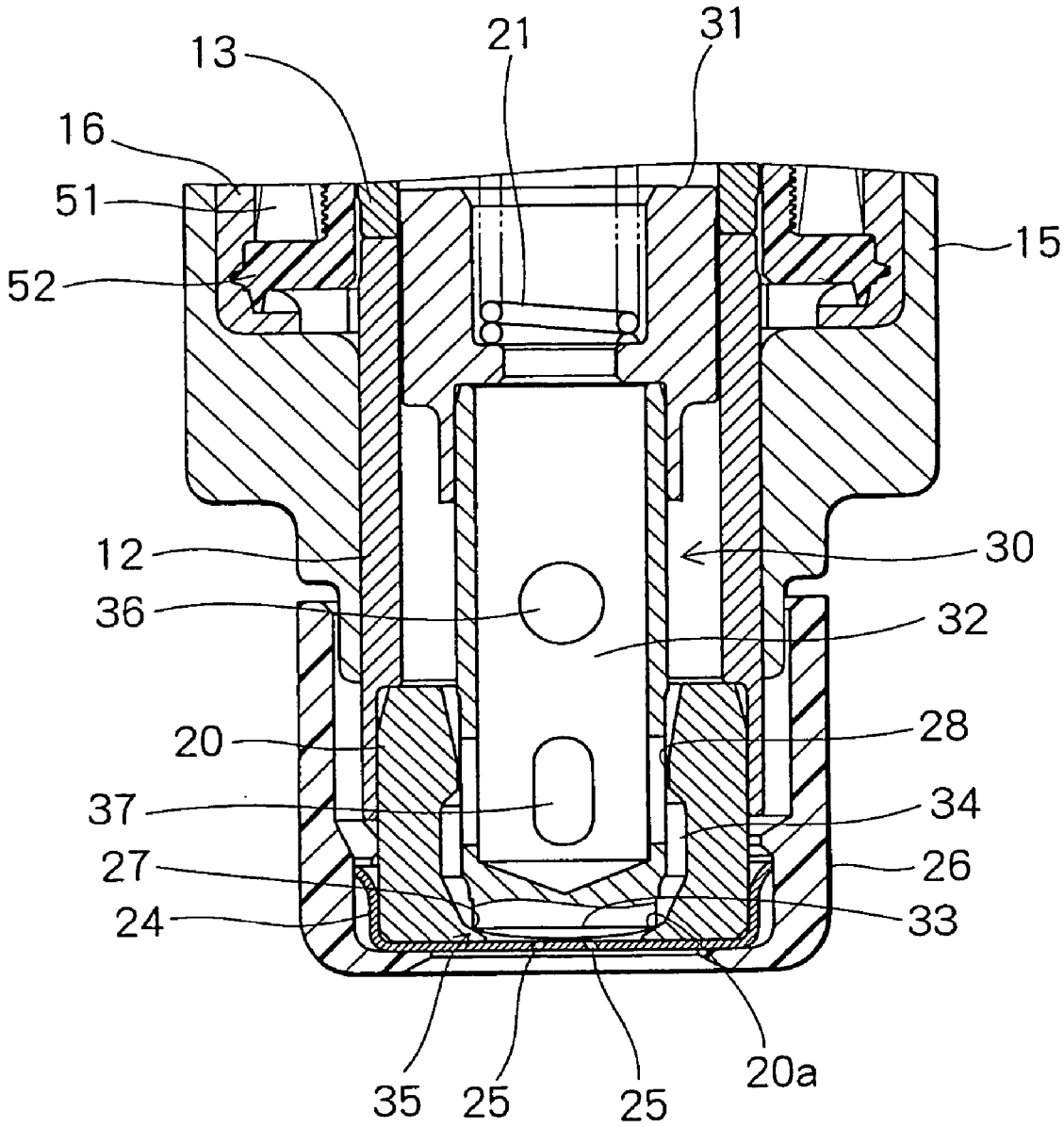
FIG. 1 is a cross-sectional view showing a neighborhood of a valve body of an injector in an enlarged scale according to a first embodiment of the present invention.

As shown in FIG. 1, an injection hole plate 24 in the shape of a cup is fixed to an outer peripheral surface of the valve body 20 by welding. The injection hole plate 24 is formed in the shape of a thin plate. A plurality of injection holes 25 is formed in the neighborhood of the center of the injection hole plate 24. A plate holder 26 is disposed outside the injection hole plate 24 so that the plate holder 26 covers the injection hole plate 24.

The needle 30 is a hollow cylinder, inside which a fuel passage 32 is formed. A contacting portion 33 is formed on the bottom surface of the needle 30 as shown in FIG. 1. The contacting portion 33 can be seated on a valve seat 27 formed on an inner peripheral surface 20*a* of the valve body 20. If the contacting portion 33 is seated on the valve seat 27, a sealing portion 35 is formed. The sealing portion 35 breaks communication between a fuel passage 34, which is formed between the needle 30 and the valve body 20, and an inlet of the injection hole 25. An external diameter of the needle 30 is formed to be slightly smaller than an internal diameter of the valve body 20 at a guiding portion 28. Therefore, a minute clearance is formed between the outer surface of the needle 30 and the inner surface of the guiding portion 28. Thus, the needle 30 is slidably held by the guiding portion 28. The guiding portion 28 is positioned radially inside the first magnetic member 12 and is formed so that the guiding portion 28 extends continuously along an inner periphery of the valve body 20. Alternatively, the guiding portion 28 may be discontinuous along the inner periphery of the valve body 20. The guiding portion 28 is positioned between the sealing portion 35 and the movable core 31 in an axial direction of the needle 30. The outer surface of the needle 30 slides in contact with the inner surface of the valve body 20 at the guiding portion 28, so axial movement of the needle 30 is guided. The outer surface of the needle 30 and the inner surface of the valve body 20 at the guiding portion 28 form guiding means. Fuel holes 36, 37 are formed in the needle 30 so that the fuel holes 36, 37 penetrate a peripheral wall of the needle 30. The fuel flowing into the fuel passage 32 of the needle 30 passes through the fuel hole 36 or the fuel hole 37, and flows to the inlet of the injection hole 25.

As shown in FIG. 2, electromagnetic driving means 50 is disposed on a side of the needle 30 opposite from the sealing portion 35. The electromagnetic driving means 50 has the movable core 31, the fixed core 22, a coil 51, a spring 21, magnetic members 15, 16, 17, 18, and the like. The movable core 31 is integrated with the needle 30 at the end of the needle 30 opposite from the sealing portion 35. An external diameter of the movable core 31 is formed to be slightly smaller than internal diameters of the first magnetic member 12 and the nonmagnetic member 13. Thus, the outer surface of the movable core 31 can slide in contact with the inner surfaces of the first magnetic member 12 and the nonmagnetic member 13. The outer surface of the movable core 31 and the inner surfaces of the first magnetic member 12 and the nonmagnetic member 13 form a core guide for guiding the axial movement of the movable core 31, which is integrated with the needle 30 on the side opposite from the sealing portion 35.

The fixed core 22 is formed in the shape of a cylinder. The fixed core 22 is press-fitted to the insides of the nonmagnetic member 13 and the second magnetic member 14. Thus, the fixed core 22 is fixed to the holder 10. The fixed core 22 is disposed on the side of the movable core 31 opposite from the contacting portion 33 and faces the movable core 31.

The adjusting pipe 23 is press-fitted to the inside of the fixed core 22. One end of the spring 21 contacts the adjusting pipe 23 and the other end of the spring 21 contacts the movable core 31. Biasing force of the spring 21 can be changed by regulating a press-fitting degree of the adjusting pipe 23. The spring 21 biases the needle 30 toward the valve seat 27.

The magnetic members 15, 16, 17, 18 are magnetically connected with each other and are disposed on an outer peripheral surface of the coil 51. The magnetic member 15 is disposed on an outer peripheral surface of the first magnetic member 12 and is magnetically connected with the first magnetic member 12. The magnetic member 16 is magnetically connected with the magnetic members 15, 17. The magnetic member 18 is magnetically connected with the magnetic member 17 and the second magnetic member 14. The fixed core 22, the movable core 31, the first magnetic member 12, the magnetic members 15, 16, 17, 18 and the second magnetic member 14 form a magnetic circuit.

A spool 52, around which the coil 51 is wound, is disposed around the outer periphery of the holder 10. A terminal 53 is electrically connected with the coil 51 and supplies driving current to the coil 51. A resin housing 54 covers the outer peripheries of the holder 10 and the coil 51.

A filter member 19 eliminates extraneous matters included in the fuel flowing into the fuel passage 11 from the upper side of the holder 10 in FIG. 2. The fuel, from which the extraneous matters are eliminated, is supplied to the fuel passage 34 between the needle 30 and the valve body 20 through the fuel passage 11, the inside of the adjusting pipe 23, the inside of the fixed core 22, the inside of the movable core 31, the fuel passage 32 of the needle 30 and the fuel hole 36 or the fuel hole 37. The fuel supplied to the fuel passage 34 flows to the injection hole 25 through an opening, which is formed between the contacting portion 33 and the valve seat 27 when the contacting portion 33 separates from the valve seat 27, and is injected from the injection hole 25.

Next, the valve body 20 and the needle 30 will be explained in detail.

Figure 3:
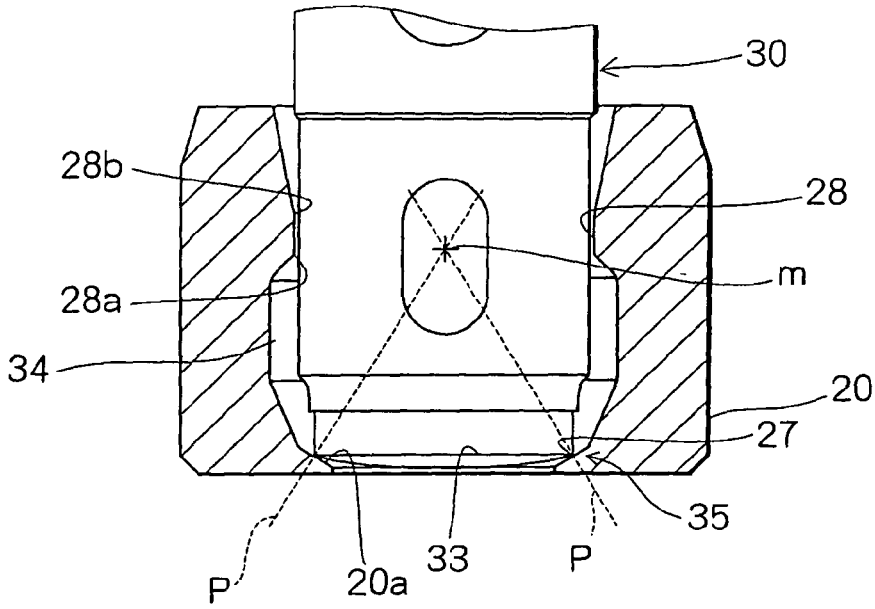
FIG. 3 is a cross-sectional view showing a physical relationship between an intersecting point m and a guiding portion of the injector according to the first embodiment.

The contacting portion 33 of the needle 30 forms the sealing portion 35 when the contacting portion 33 is seated on the valve seat 27 of the valve body 20. The sealing portion 35 is formed in an annular shape along the inner periphery of the valve body 20. As shown in FIG. 3, the inner peripheral surface 20*a* forming the sealing portion 35 is formed in the shape of a truncated cone, which opens toward the movable core 31. Therefore, a plurality of virtual perpendicular lines P, which crosses the sealing portion 35 perpendicularly to the inner peripheral surface 20*a*, intersects with each other at an intersecting point m inside the needle 30. The needle 30 tends to incline with respect to the axis more as its whole length L (shown in FIG. 4) including the movable core 31 decreases as shown by a broken line in FIG. 5. In this case, the needle 30 inclines around the intersecting point m, while contacting the inner peripheral surface 20*a*. More specifically, the end of the needle 30 on the sealing portion 35 side rotates around the intersecting point m, while contacting the inner peripheral surface 20*a*.

Figure 6:
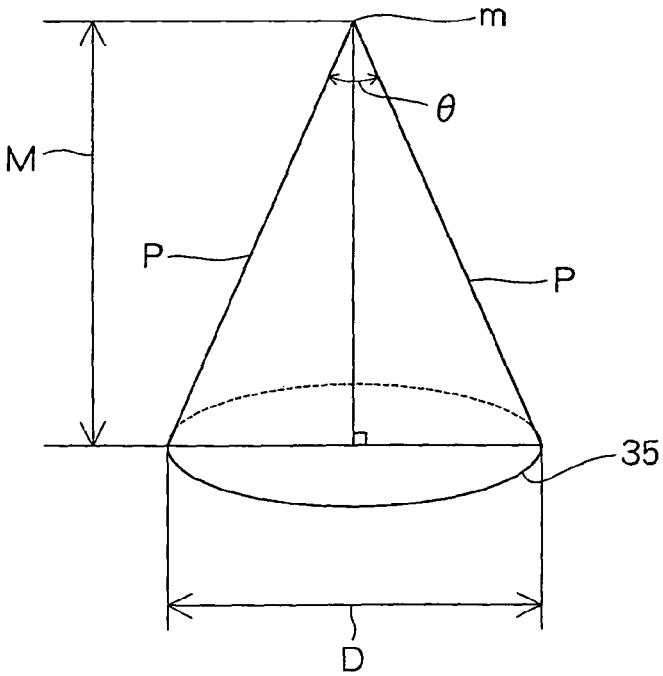
FIG. 6 is a schematic diagram showing a physical relationship between the intersecting point m and a sealing portion of the injector according to the first embodiment.

The sealing portion 35 is formed in the annular shape on the inner peripheral surface 20*a*. Therefore, a set of the perpendicular lines P extending from the sealing portion 35 to the intersecting point m forms a cone, whose apex is the intersecting point m, whose generating line is the perpendicular line P, and whose bottom surface is a plane radially inside the sealing portion 35, as shown in FIG. 6. Therefore, a distance M in the axial direction of the injector 1 between the sealing portion 35 and the intersecting point m is calculated from a following equation:

$$M=D/2\times\cot(\theta/2),$$

wherein D is the internal diameter of the sealing portion 35 and θ is an apex angle of the cone shown in FIG. 6. The apex angle θ is an angle provided by the two perpendicular lines P respectively extending from two points on the sealing portion 35, which are distant from each other the most on the sealing portion 35.

As shown in FIG. 3, the intersecting point m, around which the needle 30 rotates, is positioned between an end 28*a* of the guiding portion 28 on the sealing portion 35 side and the other end 28*b* of the guiding portion 28 opposite from the sealing portion 35. Thus, the intersecting point m is positioned near the ends 28*a*, 28*b* of the guiding portion 28. Accordingly, the contact between the needle 30 and the ends 28*a*, 28*b* of the guiding portion 28 is inhibited even if the needle 30 inclines. If the needle 30 rotates around the intersecting point m positioned between the ends 28*a*, 28*b* of the guiding portion 28, the movable core 31 on the side of the needle 30 opposite from the sealing portion 35 also rotates around the intersecting point m as shown by a broken line in FIG. 5. At that time, a moving distance at a certain point on the needle 30 from an initial position with respect to the rotational angle increases as a distance between the certain point and the intersecting point m increases. The initial position is a position at the time when the needle 30 is not inclining. Therefore, the moving distance of the movable core 31 at an end 31*a* of the movable core 31 on the side opposite from the needle 30 is greater than that of the needle 30 near the guiding portion 28. As a result, the movable core 31 contacts the nonmagnetic member 13 before the needle 30 contacts the guiding portion 28, and the further inclination of the needle 30 is prevented. Thus, the contact between the needle 30 and the guiding portion 28 is prevented.

Figure 4:
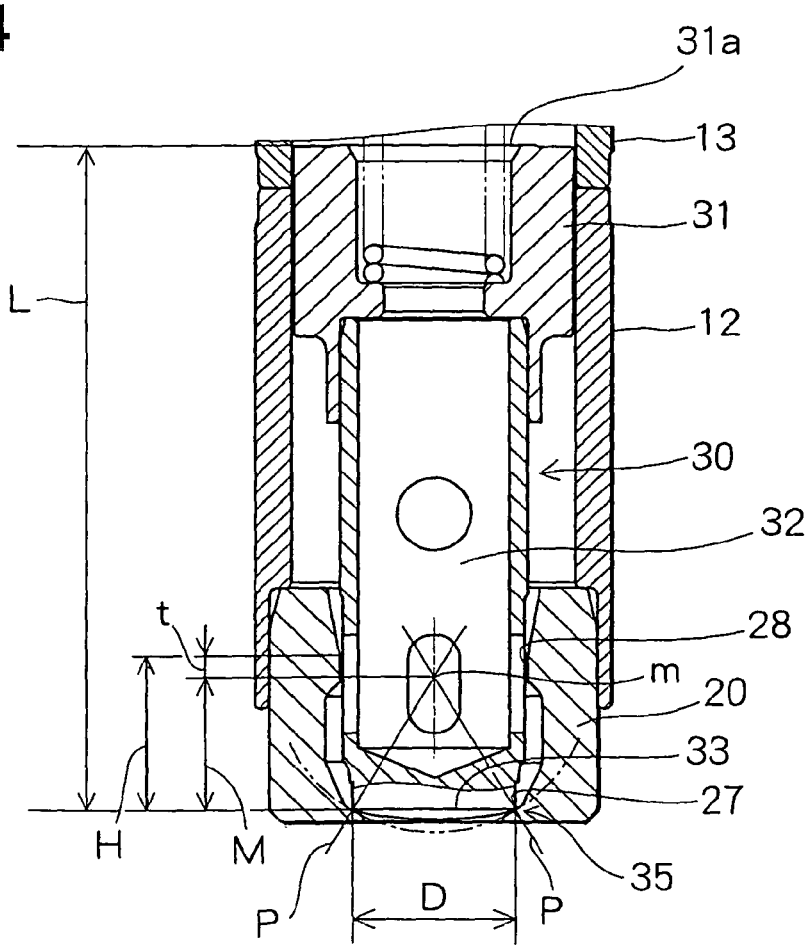
FIG. 4 is a cross-sectional view showing a physical relationship between the valve body and a needle of the injector according to the first embodiment.
Figure 5:
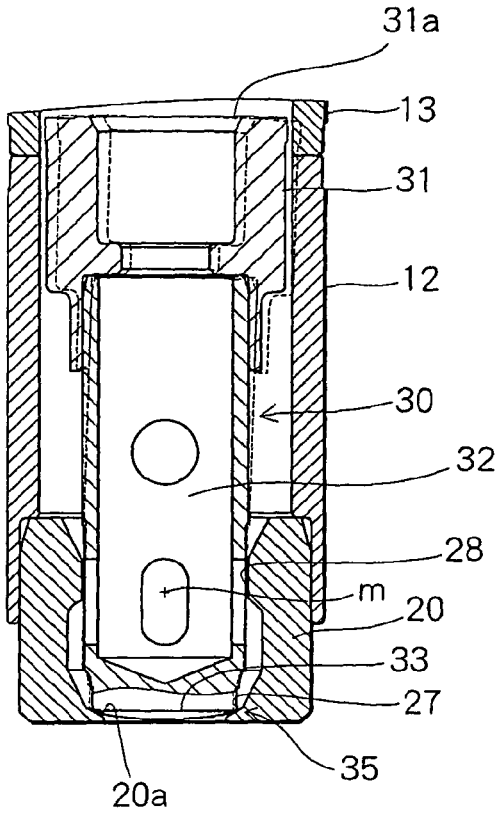
FIG. 5 is a cross-sectional view showing the valve body and the needle of the injector in a state in which the needle rotates around the intersecting point m according to the first embodiment.

As shown in FIG. 4, a distance t in the axial direction between the intersecting point m and the end 28*b* of the guiding portion 28 opposite from the sealing portion 35 is calculated from a following equation:

$$t=H-M,$$

where H is a distance in the axial direction between the sealing portion 35 and the end 28*b* of the guiding portion 28 and M is a distance in the axial direction between the sealing portion 35 and the intersecting point m. In the present embodiment, the distance L in the axial direction between the sealing portion 35 and the end 31*a* of the movable core 31 opposite from the sealing portion 35 is equal to or less than 18 mm. More specifically, the whole axial length of the needle 30 and the movable core 31 is set to be equal to or less than 18 mm. In the present embodiment, the distance t is set to be equal to or less than one tenth of the distance L. In the present embodiment, the intersecting point m is positioned between the end 28*a* of the guiding portion 28 on the sealing portion 35 side and the other end 28*b* of the guiding portion 28 opposite from the sealing portion 35, and the distance t is set to be equal to or less than one tenth of the distance L as explained. Thus, even if the whole length L of the needle 30 and the movable core 31 is equal to or less than 18 mm, the contact between the needle 30 and the guiding portion 28 can be prevented.

Next, operation of the injector 1 according to the first embodiment will be explained.

While the coil 51 is not energized, magnetic attraction is not generated between the movable core 31 and the fixed core 22. At that time, the spring 21 continues biasing the needle 30 toward the valve seat 27. Therefore, the needle 30 is held at the valve body 20 side, and the contacting portion 33 remains seated on the valve seat 27. Therefore, the fuel injection from the injection hole 25 remains stopped.

If the energization to the coil 51 is started, the magnetic flux flows through the magnetic circuit formed with the fixed core 22, the movable core 31, the first magnetic member 12, the magnetic members 15, 16, 17, 18 and the second magnetic member 14. Accordingly, the magnetic attraction is generated between the fixed core 22 and the movable core 31. Thus, the fixed core 22 attracts the movable core 31. Meanwhile, the needle 30 integrated with the movable core 31 moves toward the fixed core 22. If the contacting portion 33 separates from the valve seat 27 with the movement of the needle 30, the fuel is injected from the injection hole 25. The movable core 31 contacts the fixed core 22, so the movement of the needle 30 is limited.

If the energization to the coil 51 is stopped again, the magnetic flux flowing through the magnetic circuit disappears, and the magnetic attraction between the fixed core 22 and the movable core 31 also disappears. Therefore, the needle 30 moves toward the valve body 20 due to the biasing force of the spring 21, and the contacting portion 33 is seated on the valve seat 27. Thus, the fuel injection from the injection hole 25 is stopped.

As explained above, in the injector 1 of the first embodiment, the intersecting point m, around which the needle 30 rotates, is positioned between the end 28*a* of the guiding portion 28 on the sealing portion 35 side and the other end 28*b* of the guiding portion 28 on the side opposite from the sealing portion 35. Since the needle 30 rotates around the intersecting point m and the intersecting point m is close to the guiding portion 28, the moving distance of the needle 30 near the guiding portion 28 is small. Therefore, the contact between the needle 30 and the guiding portion 28 can be inhibited without enlarging the clearance between the needle 30 and the guiding portion 28. More specifically, if the needle 30 inclines largely, the movable core 31 and the nonmagnetic member 13, which are distant from the intersecting point m, contact each other, and the inclination of the needle 30 is limited. As a result, the contact between the needle 30 and the guiding portion 28 or the rotation of the needle 30 around the end 28*b* of the guiding portion 28 opposite from the sealing portion 35 is prevented. Therefore, even if the whole length of the needle 30 is contracted, the decrease in the sealing performance at the sealing portion 35 can be prevented. Moreover, the stability of the needle 30 during the operation is improved, so the variation in the fuel injection quantity can be prevented.

In the first embodiment, there is no need to reduce the clearance between the movable core 31 and the nonmagnetic member 13 in order to reduce the inclination of the needle 30. Therefore, there is no need to increase dimensional accuracy of the movable core 31 and the nonmagnetic member 13. Therefore, increase in manufacturing man-hours can be prevented.

In the first embodiment, the whole length of the needle 30 is reduced and the needle 30 is formed in the shape of a hollow cylinder. Therefore, the weight of the needle 30 is reduced. Accordingly, the size of the coil 51 for driving the needle 30 can be reduced, and the biasing force of the spring 21 for biasing the needle 30 in a direction opposite to the electromagnetic force can be reduced. As a result, the response of the needle 30 during the operation can be improved.

(Second Embodiment)

Next, an injector according to the second embodiment of the present invention will be explained based on FIG. 7.

Figure 7:
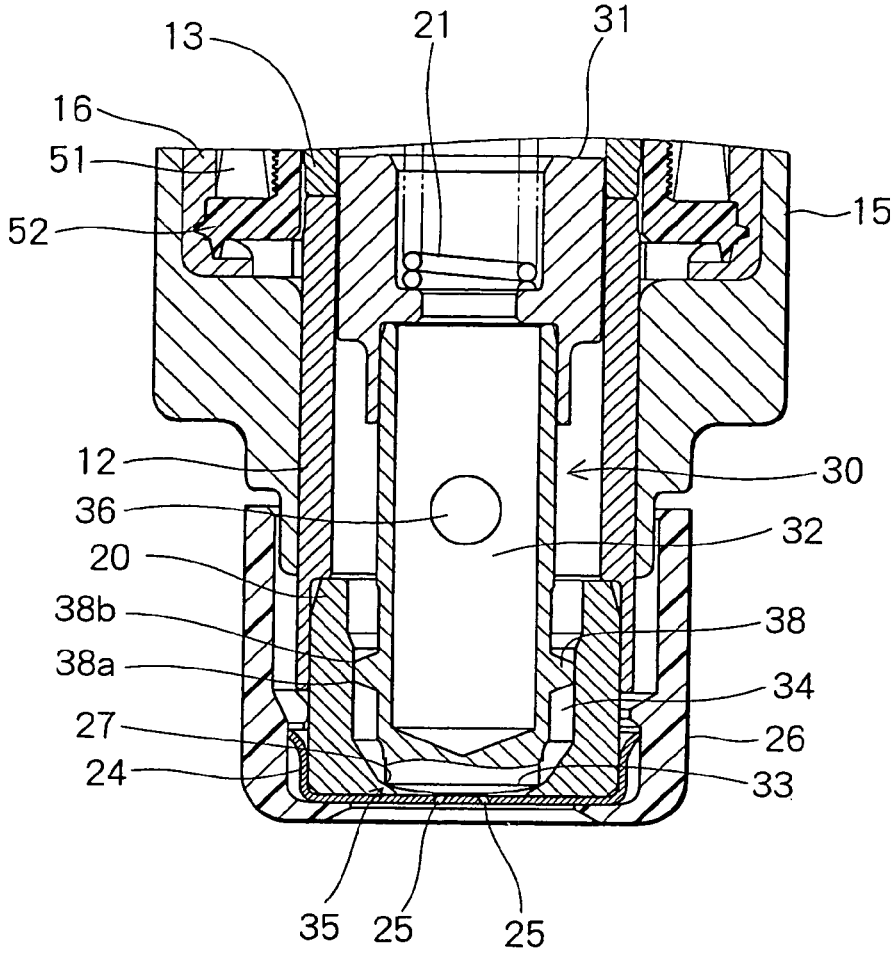
FIG. 7 is a cross-sectional view showing a neighborhood of a valve body of an injector in an enlarged scale according to a second embodiment of the present invention.

As shown in FIG. 7, shapes of a valve body 20 and a needle 30 of the injector according to the second embodiment are different from those of the first embodiment. In the second embodiment, the needle 30 has a guiding portion 38 protruding radially outward. An external diameter of the guiding portion 38 is formed to be slightly smaller than an internal diameter of the valve body 20 so that an outer surface of the guiding portion 38 can slide in contact with an inner surface of the valve body 20. In the second embodiment, an outer surface of the needle 30 at the guiding portion 38 and the inner surface of the valve body 20 form guiding means. The needle 30 is guided so that the needle 30 can reciprocate in an axial direction, since the outer surface of the guiding portion 38 slides in contact with the inner surface of the valve body 20. The guiding portion 38 is formed discontinuously along the outer periphery of the needle 30. Thus, fuel passing through a fuel hole 36 flows into a sealing portion 35 side through gaps of the discontinuous guiding portion 38 formed on the needle 30.

In the second embodiment, like the first embodiment, an intersecting point m, around which the needle 30 rotates, is positioned between an end 38*a* of the guiding portion 38 on the sealing portion 35 side and the other end 38*b* of the guiding portion 38 on the side opposite from the sealing portion 35. Therefore, even if the whole length of the needle 30 is reduced, decrease in sealing performance at the sealing portion 35 can be prevented.

(Third Embodiment)

Next, an injector according to the third embodiment of the present invention will be explained based on FIG. 8.

Figure 8:
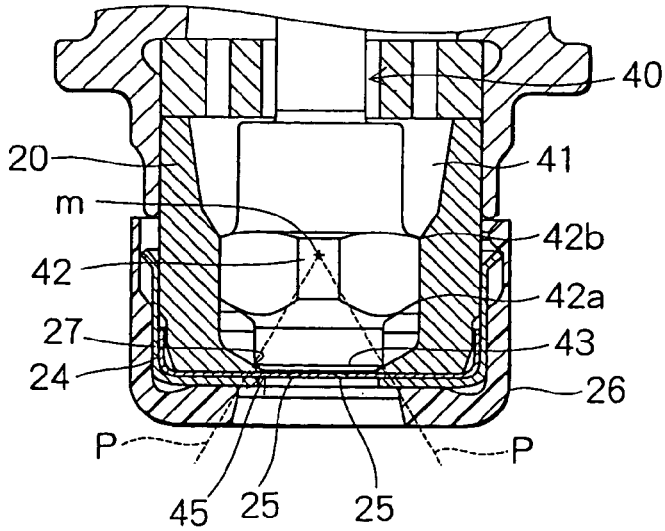
FIG. 8 is a cross-sectional view showing a neighborhood of a valve body of an injector in an enlarged scale according to a third embodiment of the present invention.

As shown in FIG. 8, the injector according to the third embodiment has a needle 40 in the form of a solid cylinder. More specifically, a fuel passage 41, through which fuel flows, is formed radially outside the needle 40. The needle 40 has a guiding portion 42. An outer surface of the guiding portion 42 can slide in contact with an inner surface of a valve body 20. In the third embodiment, the outer surface of the needle 40 at the guiding portion 42 and the inner surface of the valve body 20 form guiding means. The needle 40 is formed discontinuously in order to allow the flow of the fuel. A contacting portion 43 of the needle 40 and a valve seat 27 of the valve body 20 form a sealing portion 45.

In the third embodiment, like the first embodiment, an intersecting point m, around which the needle 40 rotates, is positioned between an end 40*a* of the needle 40 on the sealing portion 45 side, and the other end 42*b* of the needle 40 on the side opposite from the sealing portion 45. Therefore, even if the whole length of the needle 40 is reduced, decrease in sealing performance at the sealing portion 45 can be prevented.

The present invention should not be limited to the disclosed embodiments, but may be implemented in many other ways without departing from the spirit of the invention.

What is claimed is:

1. A fuel injection device, comprising:

a valve body having an injection hole and a valve seat formed on an inner peripheral surface thereof on a fuel inlet side of the injection hole;

a valve member including a contacting portion forming a sealing portion together with the valve seat and a movable core disposed at an end of the valve member opposite from the contacting portion, wherein fuel injection from the injection hole is allowed if the contacting portion separates from the valve seat and the fuel injection is stopped if the contacting portion is seated on the valve seat; and guiding means for guiding the valve member so that the valve member can reciprocate in an axial direction of the fuel injection device, wherein the guiding means is formed with an inner surface of the valve body and an outer surface of the valve member, which slides in contact with the inner surface of the valve body, wherein the fuel injection device is formed so that arbitrary virtual perpendicular lines, which cross the sealing portion and are perpendicular to the inner peripheral surface of the valve body providing the valve seat, intersect with each other at an intersecting point, which is positioned between a first end of the guiding means on a sealing portion side and a second end of the guiding means opposite from the sealing portion, and a distance in the axial direction between the sealing portion and an end of the movable core opposite from the sealing portion is equal to or less than 18 millimeters.

2. The fuel injection device as in claim 1, wherein the guiding means is formed continuously along an inner periphery of the valve body.

3. The fuel injection device as in claim 1, wherein the valve member is formed in the shape of a cylinder, in which a fuel passage is formed.

4. The fuel injection device as in claim 1, further comprising:

electromagnetic driving means including a coil, the movable core, and a fixed core, wherein magnetic attraction is generated between the movable core and the fixed core if the coil is energized.

5. The fuel injection device as in claim 4, wherein the fuel injection device is formed so that a distance in the axial direction between the intersecting point and the second end of the guiding means opposite from the sealing portion is equal to or less than one tenth of a distance in the axial direction between the sealing portion and an end of the movable core opposite from the sealing portion.

6. The fuel injection device as in claim 4, further comprising:

a holder having an inner surface, with which an outer surface of the movable core can slide in contact.

7. The fuel injection device as in claim 1, wherein the fuel injection device is formed so that a distance in the axial direction between the sealing portion and the intersecting point is calculated from a following equation:

$$M=D/2\times\cot(\theta/2),$$

where M represents the distance in the axial direction between the sealing portion and the intersecting point, D is a diameter of the sealing portion and θ is an angle provided by the two virtual perpendicular lines respectively extending from two points on the sealing portion, the two points being distant from each other the most on the sealing portion.

8. The fuel injection device as in claim 1, wherein the valve member is formed in the shape of a cylinder and the inner peripheral surface of the valve body providing the valve seat is inclined with respect to the axis of the fuel injection device so that an opening area provided by the inner peripheral surface increases toward the valve member.

9. A fuel injection device, comprising:

a valve body having an injection hole and a valve seat formed on an inner peripheral surface thereof on a fuel inlet side of the injection hole;

a valve member including a contacting portion forming a sealing portion together with the valve seat, wherein fuel injection from the injection hole is allowed if the contacting portion separates from the valve seat and the fuel injection is stopped if the contacting portion is seated on the valve seat; and guiding means for guiding the valve member so that the valve member can reciprocate in an axial direction of the fuel injection device, wherein the guiding means is formed with an inner surface of the valve body and an outer surface of the valve member, which slides in contact with the inner surface of the valve body, wherein the fuel injection device is formed so that arbitrary virtual perpendicular lines, which cross the sealing portion and are perpendicular to the inner peripheral surface of the valve body providing the valve seat, intersect with each other at an intersecting point, which is positioned between a first end of the guiding means on a sealing portion side and a second end of the guiding means remote from the sealing portion, and a distance in the axial direction between the intersecting point and the second end of the guiding means is equal to or less than 1.8 millimeters.

10. The fuel injection device as in claim 9, wherein the guiding means is formed continuously along an inner periphery of the valve body.

11. The fuel injection device as in claim 9, wherein the valve member is formed in the shape of a cylinder, in which a fuel passage is formed.

12. The fuel injection device as in claim 9, further comprising:

electromagnetic driving means including a coil, a movable core disposed on an end of the valve member remote from the contacting portion, and a fixed core, wherein magnetic attraction is generated between the movable core and the fixed core if the coil is energized.

13. The fuel injection device as in claim 12, wherein the fuel injection device is formed so that said distance in the axial direction between the intersecting point and the second end of the guiding means is equal to or less than one tenth of a distance in the axial direction between the sealing portion and an end of the movable core remote from the sealing portion.

14. The fuel injection device as in claim 13, wherein the fuel injection device is formed so that the distance in the axial direction between the sealing portion and the end of the movable core remote from the sealing portion is equal to or less than 18 millimeters.

15. The fuel injection device as in claim 12, further comprising:

a holder having an inner surface, with which an outer surface of the movable core can slide in contact.

16. The fuel injection device as in claim 9, wherein the fuel injection device is formed so that a distance in the axial direction between the sealing portion and the intersecting point is calculated from a following equation:

$$M=D/2\times\cot(\theta/2),$$

where M represents the distance in the axial direction between the sealing portion and the intersecting point, D is a diameter of the sealing portion and θ is an angle provided by the two virtual perpendicular lines respectively extending from two points on the sealing portion, the two points being distant from each other the most on the sealing portion.

17. The fuel injection device as in claim 9, wherein the valve member is formed in the shape of a cylinder and the inner peripheral surface of the valve body providing the valve seat is inclined with respect to the axis of the fuel injection device so that an opening area provided by the inner peripheral surface increases toward the valve member.

* * * * *